US005529413A

United States Patent [19]

Kamikubota et al.

[11] Patent Number: 5,529,413

[45] Date of Patent: Jun. 25, 1996

[54] PROTECTIVE SHEET FOR RECORDING SHEETS AND PRINTER IN USE THEREWITH

[75] Inventors: Masafumi Kamikubota; Toshiaki Fujimaki; Kenji Yamakawa, all of Saitama, Japan

[73] Assignee: Fuji Photo Film Co., Ltd., Kanagawa, Japan

[21] Appl. No.: 296,178

[22] Filed: Aug. 29, 1994

[30] Foreign Application Priority Data

Sep. 3, 1993 [JP] Japan ..... 5-220301

[51] Int. Cl.[6] ..... B41J 11/46

[52] U.S. Cl. ..... 400/582; 400/708; 101/409

[58] Field of Search ..... 428/409; 400/649, 400/625, 708, 624, 279, 582, 596; 283/74; 101/408, 409; 271/82

[56] References Cited

U.S. PATENT DOCUMENTS

| | | | |
|---|---|---|---|
| 4,594,597 | 6/1986 | Liu et al. | 400/625 |
| 4,891,655 | 1/1990 | Watanabe | 400/649 |
| 5,135,905 | 8/1992 | Egashira et al. | 428/409 |
| 5,149,218 | 9/1992 | Iwatani et al. | 400/625 |

FOREIGN PATENT DOCUMENTS 1249493 10/1989 Japan .

*Primary Examiner*—John S. Hilten
*Attorney, Agent, or Firm*—Birch, Stewart, Kolasch & Birch

[57] ABSTRACT

A protective sheet protects a recording surface of a recording sheet. Plural recording sheets are stacked with the recording surface of the recording sheets oriented toward the protective sheet. The recording sheet is fed for recording while an advancing edge of the recording sheet is advanced. The protective sheet includes a discriminative mark, disposed away from the advancing edge and on a surface oriented opposite to the plural recording sheets for signaling presence of the protective sheet. For use with those sheets, a printer records with a thermal head on a recording surface of a recording sheet set on a platen drum in rotation of the platen drum. The advancing edge is clamped by a clamper on the platen drum. The recording sheets and the protective sheet are fed one after another toward the platen drum, to pass the advancing edge of the one fed sheet inside the clamper. The advancing edge at the clamper is detected by the position sensor. The one fed sheet is mounted on the platen drum while rotating the platen drum after the clamper clamps the advancing edge. Presence of the discriminative mark is detected on the one fed sheet on the platen drum. If the discriminative mark is detected, the one fed sheet is judged as the protective sheet, to exit at least the protective sheet from the platen drum.

14 Claims, 7 Drawing Sheets

PROTECTIVE SHEET FOR RECORDING SHEETS AND PRINTER IN USE THEREWITH

BACKGROUND OF THE INVENTION

1. Field of the Invention

The present invention relates to a protective sheet for recording sheets and a printer in use therewith. More particularly, the present invention relates to an improvement in which a protective sheet used with plural recording sheets is automatically treated.

2. Description Related to the Prior Art

A thermal printer is used with sheets of thermosensitive recording material, which includes a support and at least one recording layer formed on the support. The thermal printer has a thermal head, with which an image is thermally recorded on the recording sheet. Ultraviolet rays of a predetermined range of wavelength are applied to the recording layer, to destroy its coloring ability, as the recording layer has optical fixability responsive to the ultraviolet rays of the limited range. If the recording sheet is exposed to light from fluorescent lamps generally used in a room for illumination, the fluorescent light influences the coloring ability of the sheet. It is usual to stack a plurality of recording sheets and wrap them in a light-shielding wrapper, bag or box, to be supplied to a user.

To load the thermal printer with the recording sheets, the light-shielding wrapper is opened first. The stacked recording sheets are taken out of the wrapper. It is inevitable that a recording surface of only one of the stacked recording sheets remains uncovered, and is exposed to ambient light including fluorescent light. To protect the coloring ability of the recording surface from influences, it is proposed to overlap a protective sheet on the uncovered recording surface for the purpose of shielding light.

It is known, as disclosed in JP-A (Japanese Patent Laid-open Publication No.) 1-249493, to use a protective sheet in a thermal printer which is of a thermal transfer type used with an ink sheet. The protective sheet is for the purpose of protecting recording surfaces from fingerprints or dust. This thermal printer has a paper sensor of a reflecting type disposed above a sheet cassette for containing the sheets to be fed. When all the recording sheets are fed, only the protective sheet remains in the sheet cassette. The protective sheet has a code printed thereon for inhibiting feeding. The paper sensor detects the inhibiting code on the protective sheet. This provides the printer with information of lack of recording sheets. The printer stops feeding the sheet.

The thermal printer can have a clamper which fixes the recording sheet on the platen drum for the thermal recording. This printer would require a home position detecting sensor for detecting a state where the clamper stands by near an end of a sheet feeding path, and a sheet advance detecting sensor for detecting whether an advancing edge of the recording sheet has come to the clamper. In addition, the platen drum might be provided with a sensor for detecting a releasing position, and a sensor for detecting a sheet being exited, for the purpose of ensuring exiting of the sheet. If the paper sensor of the above document is disposed in association with the sheet cassette, this may raise the cost of the printer, as wires connecting the relevant circuits may be complicated. Steps of assembling the printer may be enlarged.

SUMMARY OF THE INVENTION

In view of the foregoing problems, an object of the present invention is to provide a protective sheet for recording sheets, and a printer in use therewith, in which the protective sheet used with the plural recording sheets is automatically treated.

Another object of the present invention is to provide a protective sheet for recording sheets, and a printer in use therewith, in which a structure detecting for the protective sheet is simplified.

In order to achieve the above and other objects and advantages of this invention, plural recording sheets are stacked with a recording surface of the recording sheets oriented toward a protective sheet. The recording sheet is fed for recording while an advancing edge of the recording sheet is advanced. The protective sheet includes a discriminative mark, disposed away from the advancing edge and on a surface oriented opposite to the plural recording sheets, for signaling presence of the protective sheet.

For use with the recording sheets and the protective sheet, a printer records an image with a recording head on a recording surface of a recording sheet set on a platen drum during a printing step in rotation of the platen drum. The recording sheet has an advancing edge clamped by a clamper on a peripheral face of the platen drum. The clamper rotates with the platen drum before or after an exiting step. A sheet cassette contains plural recording sheets and a protective sheet, the plural recording sheets stacked with the recording surface of the recording sheets oriented toward the protective sheet, the protective sheet including at least one discriminative mark, disposed away from the advancing edge and on a surface oriented opposite to the plural recording sheets, for signaling presence of the protective sheet. A feeding device feeds the recording sheets and the protective sheet one after another through a top of the sheet cassette and toward the platen drum, while advancing the advancing edge. A sensor device detects the advancing edge of the one fed sheet set in clampable fashion at the clamper, and detects presence of the discriminative mark on the one fed sheet mounted on the platen drum. A controller executes the exiting step if the sensor device detects the discriminative mark, the one fed sheet judged as the protective sheet.

In a preferred embodiment, the discriminative mark and the platen drum have a color of which a factor of optical reflectance is lower than the recording sheet.

In accordance with the present invention, the protective sheet used with the plural recording sheets can be automatically treated in highly efficient fashion. The structure detecting for the protective sheet in the printer is simplified.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
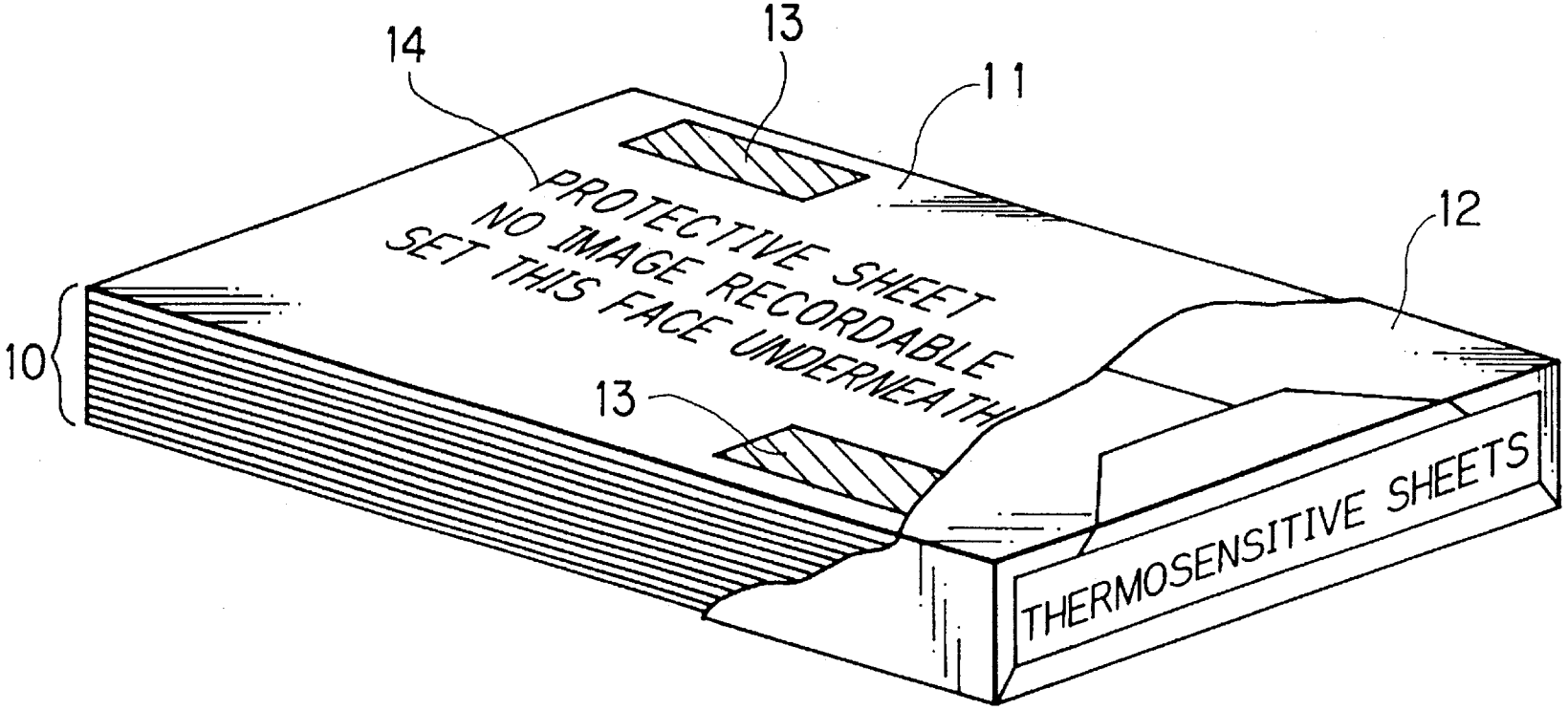
FIG. 1 is a perspective view, partly broken, illustrating a protective sheet with recording sheets wrapped in a wrapper.

In FIG. 1, plural thermosensitive recording sheets 10 are stacked together with their recording surfaces directed in an equal direction. A protective sheet 11 is lapped on an uncovered one of the recording surfaces, for the purpose of protecting the recording sheets 10 from ambient light and being scratched. All of the recording sheets 10 and the protective sheet 11 are packaged in a wrapper 12. The protective sheet 11 is provided with a discriminative mark 13 and a literal notice indication 14 printed thereon. Although the protective sheet 11 is to be laid at a bottom in a thermal printer, it is possible to orient the package of the recording sheets 10 in any direction.

The protective sheet 11 is white, and has discriminative marks 13 colored black. The discriminative marks 13 may not be black, but can have a dark color having a sufficiently low factor of reflectance. It is possible for the discriminative marks 13 to be definitely different in density or in color from blank portions of the protective sheet 11. The blank portions of the protective sheet 11 is white, but can be black or blue. The protective sheet 11 consists of paper, but can be a plastic sheet. The discriminative marks 13 are printed on the protective sheet 11 to be rotationally symmetrical, so that the sheets 10 and 11 can be set into a sheet cassette without consideration of either longitudinal direction of the sheets. The notice indication 14 indicates that the protective sheet 11 is present, and that the printer requires new recording sheets, as the protective sheet 11 appears after a final recording sheet is used up.

To load the thermal printer with the recording sheets 10, the wrapper 12 is torn. All the recording sheets 10 and the protective sheet 11 are taken out, and inserted in a sheet cassette 15 to lay the protective sheet 11 at the bottom. The sheet cassette 15 is set into a cassette chamber 16 in the thermal printer.

In the top of the cassette chamber 16 is disposed a feeding roller 17, which advances an uppermost recording sheet 10 into a feeding path 18. The feeding path 18 has a pair of advancing rollers 19, which feed the recording sheet 10 toward a platen drum 20. The platen drum 20 is driven by a stepping motor 22 via a platen shaft 21. The stepping motor 22 is controlled by a controller 25 by a driver 23.

The platen drum 20 has a clamper 27 for fixing an advancing edge 10*a* of the recording sheet 10 on a peripheral face 20*a* of the platen drum 20. The clamper 27 is mounted about a platen shaft 21 which lies through a slot 27*a*. On a lateral face 27*b* of the clamper 27, a clamper actuating device or solenoid 28 is fixed, and has a ring portion 29, which is mounted about the platen shaft 21. As is well-known in the art, the solenoid 28 incorporates a spring, which biases to pull the ring portion 29 toward the solenoid 28. The clamper 27 is biased by a spring to fix the advancing edge 10*a* of the recording sheet 10 on the drum face 20*a*, when the solenoid 28 does not stand energized. When the solenoid 28 stands energized, the ring portion 29 is projected forcibly against the spring, to open the clamper 27 away from the drum face 20*a*.

Figure 2:
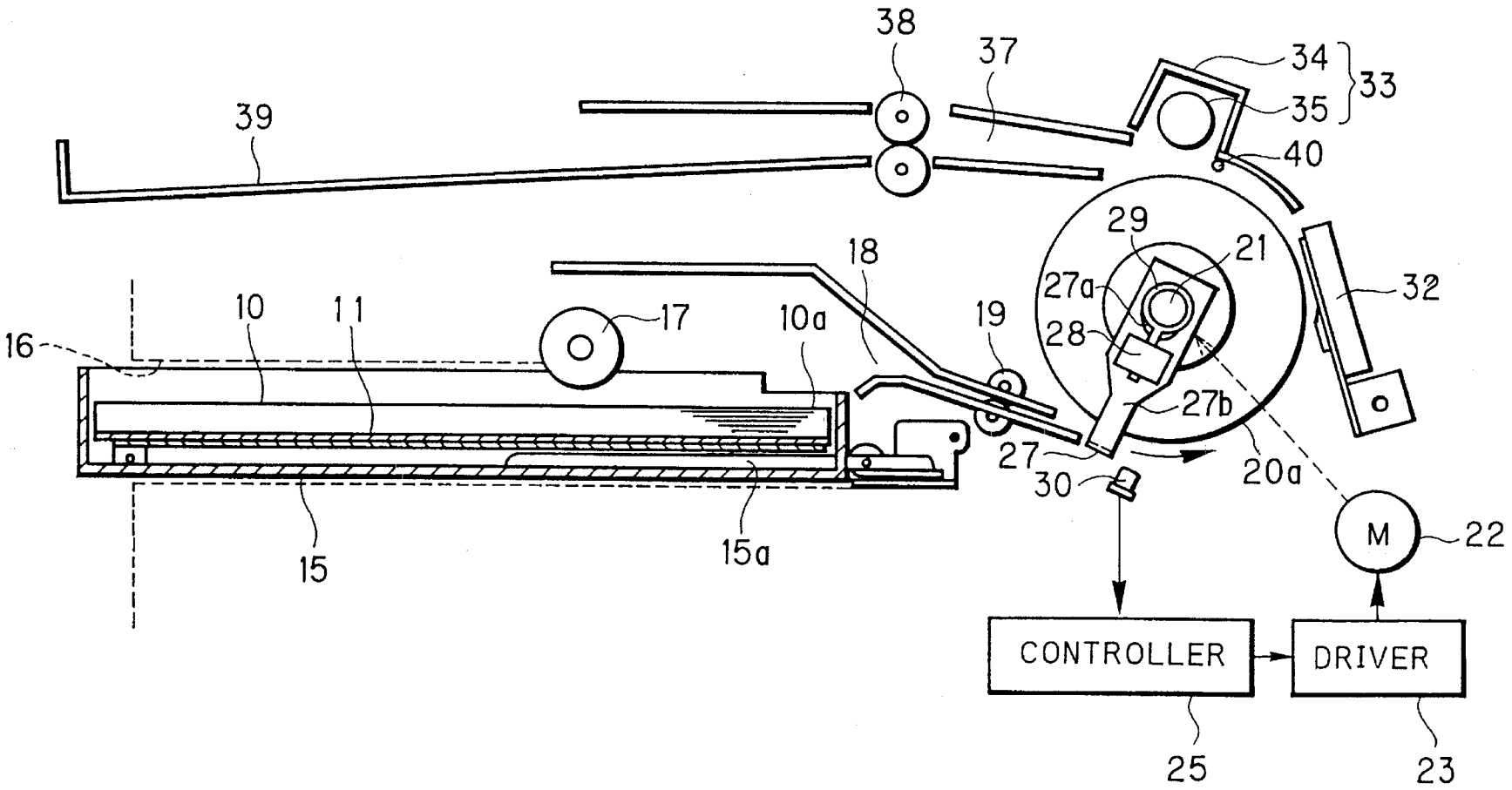
FIG. 2 is an explanatory view schematically illustrating a thermal printer.
Figure 5A:
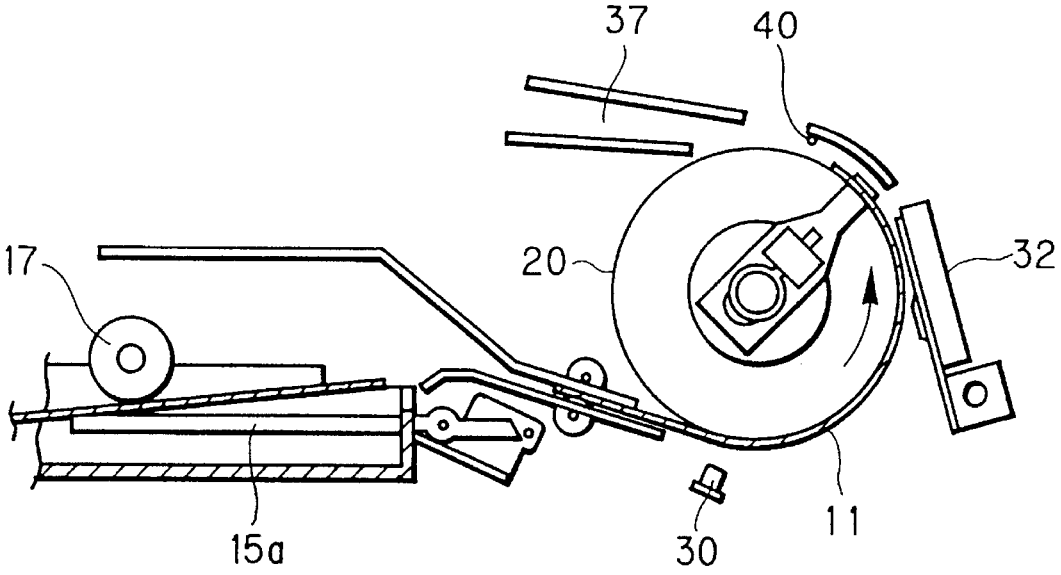
FIGS. 5A and 5B are explanatory views illustrating steps of detecting and exiting the protective sheet.
Figure 5B:
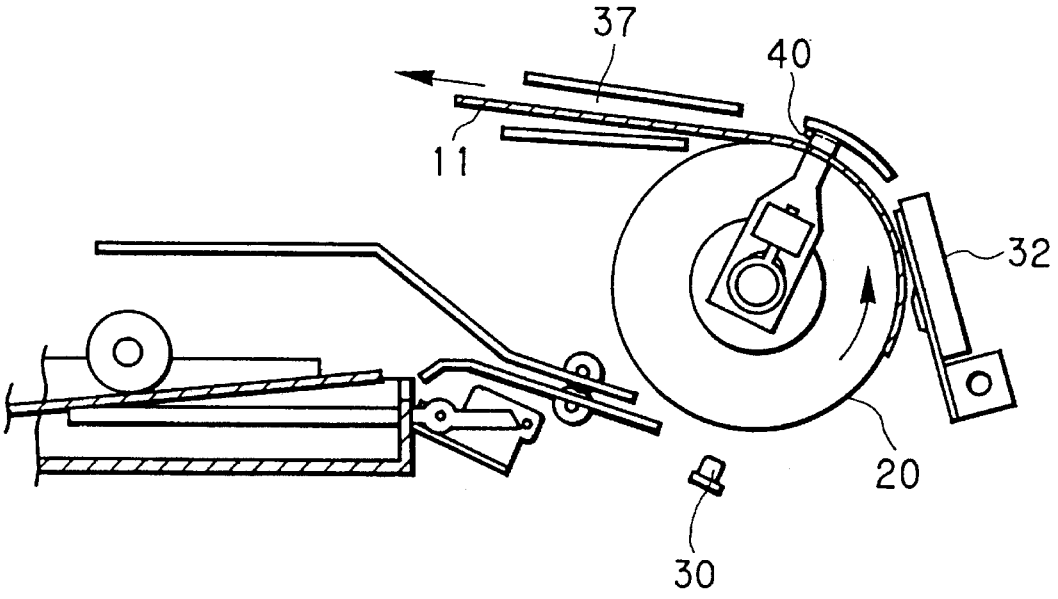
Figure 6:
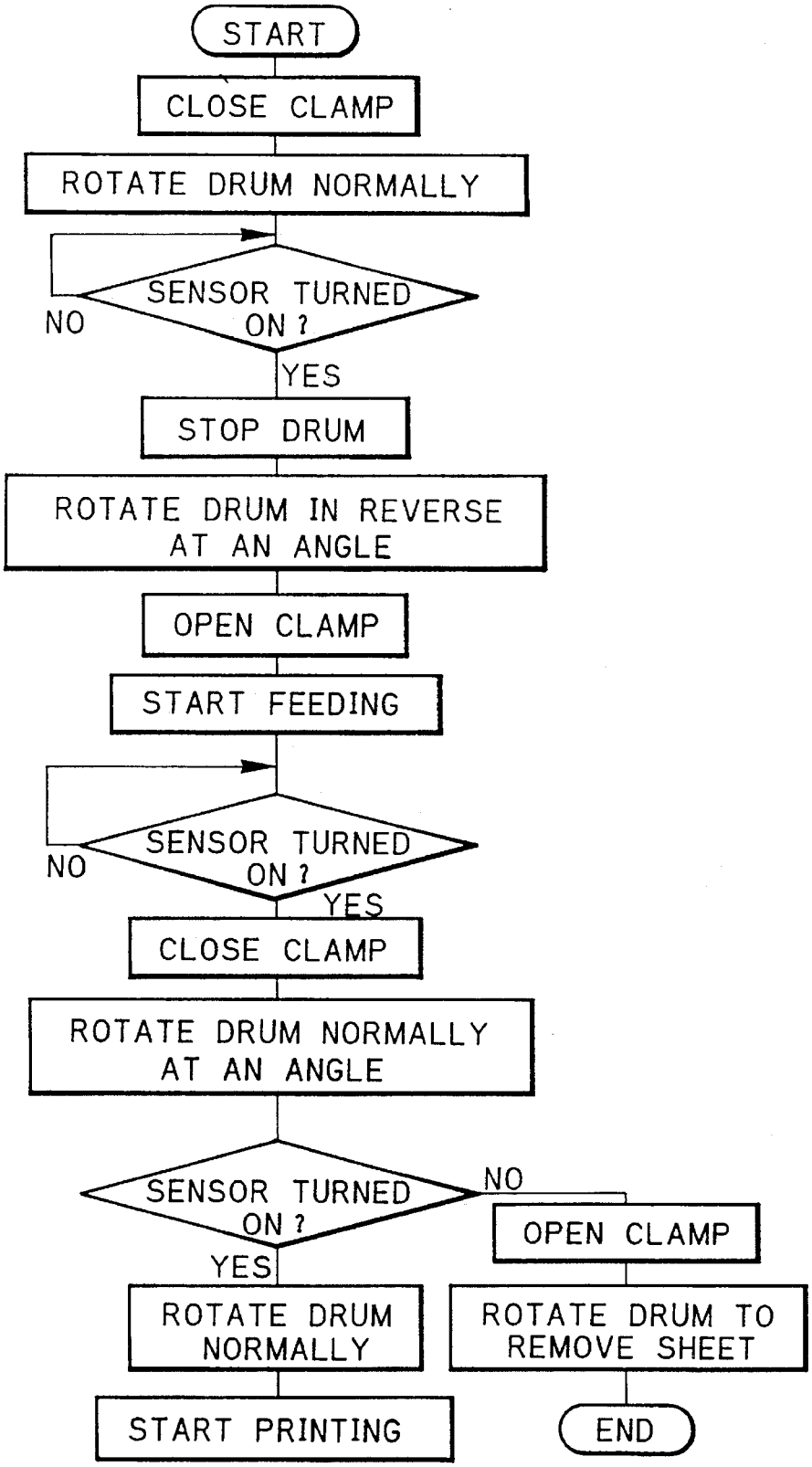
FIG. 6 is a flow chart illustrating a sequence of handling each of the recording and protective sheets.

In the feeding station (See FIG. 2) and the exiting station (See FIG. 5B), the clamper 27 stands opened for feeding and exiting the sheets. In the feeding station, the clamper 27 having the open state stands by. When the advancing edge 10*a* passes through the clamper 27 to come beyond it, the advancing edge 10*a* is detected by a sensor. In response to the detection, the recording sheet 10 is clamped. In the exiting station, the clamper 27 opens. The platen drum is normally rotated to exit the sheet.

The sheet feeding station has a home position detecting sensor 30, which detects a home position of the clamper 27. The position sensor 30 consists of a photo sensor of a reflective type, and is used also as a sheet sensor, and detects the advancing edge 10*a* from the clamper 27. In response to the clamper 27 at the position sensor 30, the controller 25 causes the platen drum 20 to rotate in reverse to a small amount, so that the advancing edge 10*a* is to be detected at the same position sensor 30.

The position sensor 30 is used also as protective sheet detecting sensor. When the protective sheet 11 comes to the recording station where the recording sheet 10 would stand by for the recording, the position sensor 30 detects the discriminative marks 13. With the discriminative marks 13 detected, the clamper 27 is opened. The platen drum 20 is continuously rotated to exit the protective sheet 11.

Near to the platen drum 20, there are disposed a thermal head 32 in a recording station for the recording sheets 10, and an optical fixing device 33 to lie past the recording station with reference to the rotating direction. The thermal head 32 has plural heating elements arranged linearly, and generate heat energy corresponding to density of each pixel.

The fixing device 33 is constituted by a long box-shaped reflector 34 extended in parallel with an axis of the platen drum 20, and a tubular ultraviolet lamp 35 contained inside the reflector 34. An exit path 37 is disposed to lie past the fixing device 33. The exit path 37 has transporting rollers 38, which nip the recording sheet 10 after the printing, and transport it to an exit tray 39.

There is arranged a stopper 40 directly before the fixing device 33. The clamper 27, when opened to unclamp the recording sheet 10, is contacted on the stopper 40, which then prevents the clamper 27 from rotating further even during the rotation of the platen drum 20. After the completion of the exit of the recording sheet, the clamper 27 come to have the clamping state and is unlatched from the stopper 40. Then the clamper 27 rotates with the rotation of the platen drum 20, as there is friction between the clamper 27 and the platen drum 20.

The operation of the above embodiment is described with reference to FIGS. 3 to 6. At first the wrapper 12 is opened. The recording sheets 10 with the protective sheet 11 are taken out. The protective sheet 11 is recognized with the notice indication 14, and laid underneath, and inserted in the sheet cassette 15 with the recording sheets 10. The sheet cassette 15 is set into the cassette chamber 16.

Figure 3A:
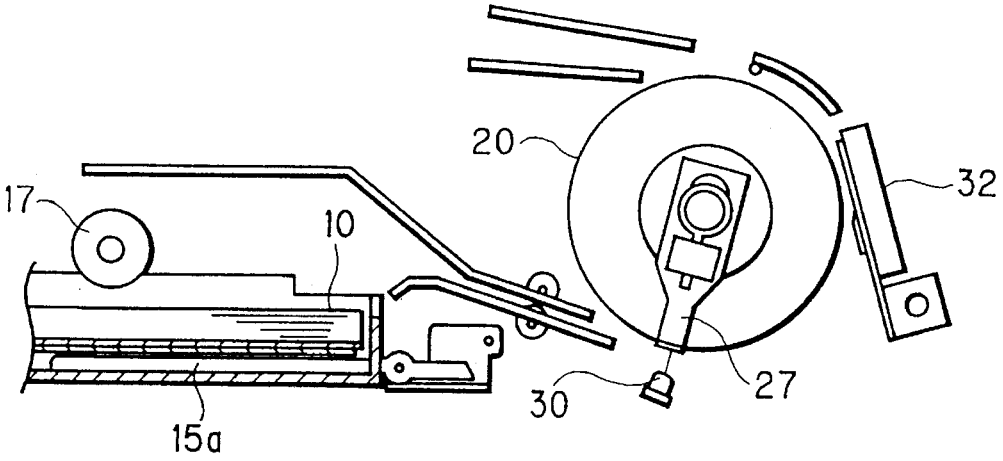
FIGS. 3A to 3C are explanatory views illustrating steps of setting a clamper, and feeding and advancing a recording sheet.
Figure 3B:
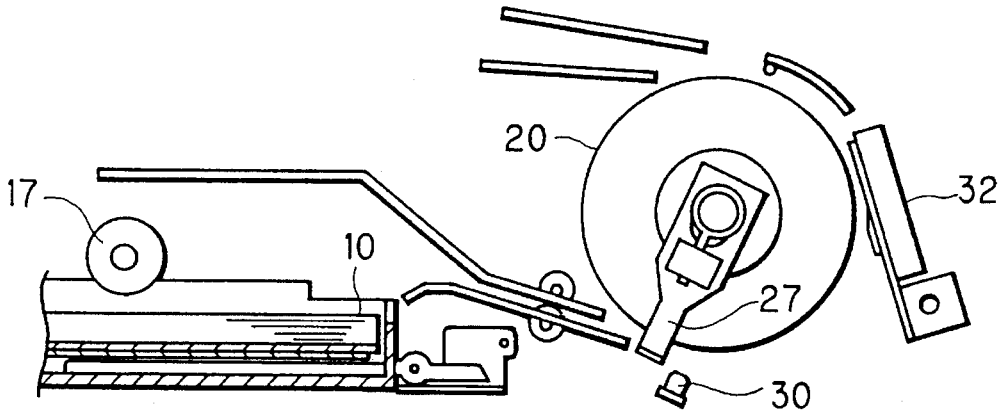

In feeding of the recording sheet 20, the platen drum 20 is rotated. The clamper 27 is moved to the position sensor 30, which is turned on thereby. The On-signal is applied to the controller 25. The controller 25, in response to the On-signal, stops the motor 22 (See FIG. 3A). The controller 25 supplies the motor 22 with drive pulses in a predetermined number, to cause the motor 22 to rotate in reverse. As illustrated in FIG. 3B, the platen drum 22, with the clamper 27, returns to a small extent. The clamper 27 is set in the home position. The clamper 27 is now retracted from the position sensor 30, which stands by for detection of the advancing edge 10*a* passed through the clamper 27. The solenoid 28 is energized to open the clamper 27.

Figure 3C:
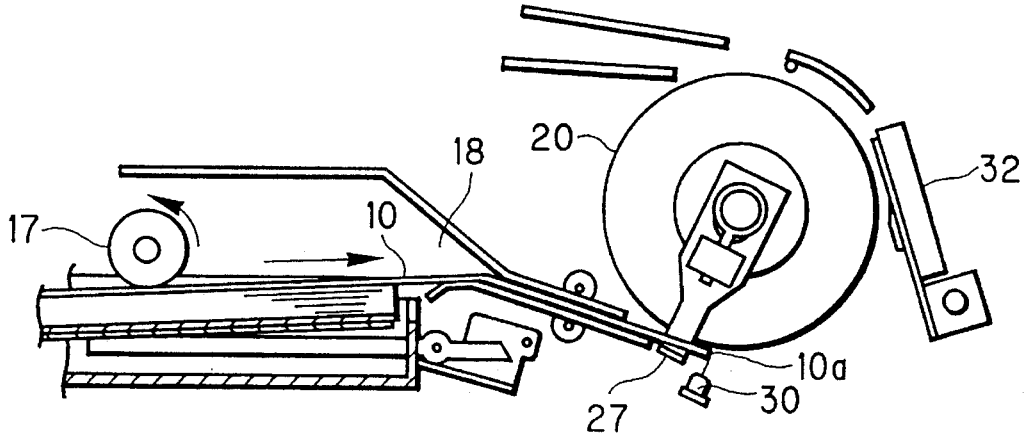
Figure 4A:
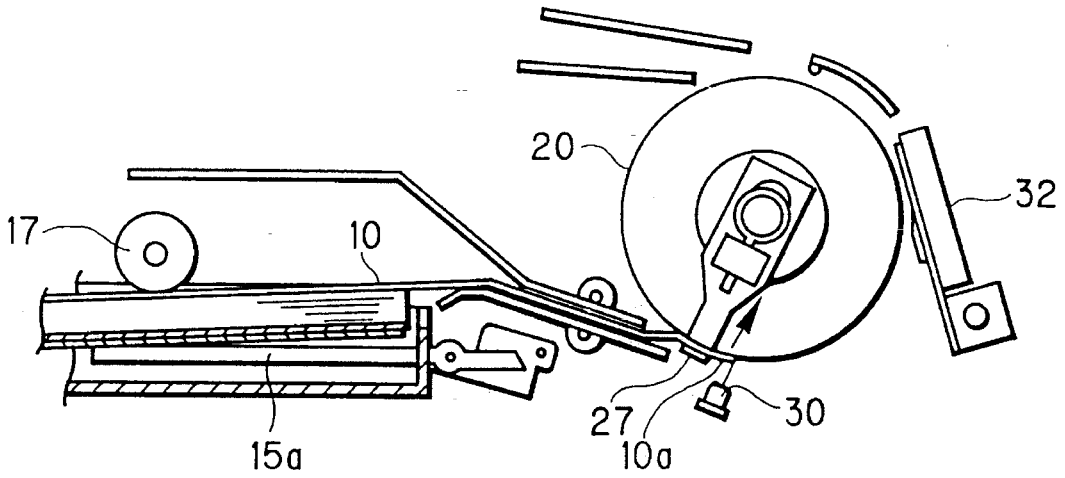
FIGS. 4A and 4B are explanatory views illustrating steps of clamping the advancing edge, and mounting the recording sheet on the platen drum.
Figure 4B:
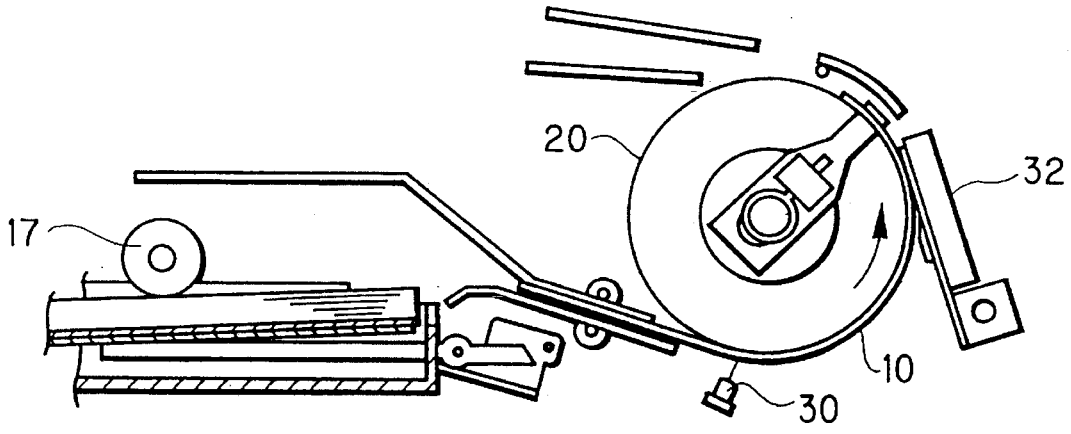

As illustrated in FIG. 3C, the recording sheets 10 are lifted by a relevant lifting mechanism in response to a sheet feeding signal. The uppermost recording sheet 10 contacts the feeding roller 17, which moves it into the feeding path 18. The advancing rollers 19 advance the recording sheet 10 toward the platen drum 20. The advancing edge 10*a*, having passed the clamper 27, is detected by the position sensor 30. The solenoid 28 is turned off. The clamper 27 is returned by the incorporated spring to recover the initial position. The advancing edge 10*a* is now clamped by the clamper 27, as illustrated in FIG. 4A. After the clamping, the stepping motor 22 is driven to rotate the platen drum 20 and the advancing rollers 19. The recording sheet 10 is fitted on the drum face 20*a* around the platen drum 20.

In the course of the rotation of the platen drum 20, the recording sheet 10 comes to the recording station. Prior to the start of the thermal recording, it is checked at the position sensor 30 whether the recording sheet 10 is present in the recording station. If it is judged that the recording sheet 10 is present, the thermal recording is started with the thermal head 32 (See FIG. 4B). The recording surface of the recording sheet 10 is positioned outside the platen drum 20. The thermal head 32 is pressed on the recording surface, and thermally records an image line after line. When an imaged portion after the recording comes under the fixing device 33, the ultraviolet lamp 35 is driven to apply ultraviolet rays to the imaged portion for the optical fixation.

The platen drum 20 makes one rotation. An exiting station detecting sensor (not shown) detects the clamper 27 coming to the exiting station. In response to this, the stepping motor 22 is stopped. The solenoid 28 is turned on to open the clamper 27. The advancing edge 10*a* is released from being clamped. Then the platen drum 20 restarts rotation. The clamper 27 is blocked by the stopper 40, and hindered from further rotation. The thermal head 32 still presses the recording sheet 10 against the platen drum 20. The recording sheet 10 is rotated with the platen drum 20, and moved through the clamper 27, separated by a separating edge 37*a* of the exit path 37, and toward the exit path 37. The recording sheet 10 is nipped by the transporting rollers 38 in the exit path 37, and exited to the exit tray 39. In the exiting of the recording sheet 10, the ultraviolet lamp 35 of the fixing device 33 is actuated, applies ultraviolet rays to a portion having been clamped under the clamper 27. The clamped portion is thus bleached.

In checking of the sheet at the position sensor 30, if it is judged that the position sensor 30 remains off, it implies that an unexpectedly shorter recording sheet is present and not detected by the position sensor 30, or that the discriminative mark 13 of the protective sheet 11 is located at the position sensor 30. Then the clamper 27 is opened. The platen drum 20 is rotated to exit the protective sheet 11 or the shorter recording sheet (see FIGS. 5A and 5B). The protective sheet 11 is exited to the exit tray 39 with the notice indication 14 oriented upward, which informs the user that the recording sheets 10 are used up.

Figure 7:
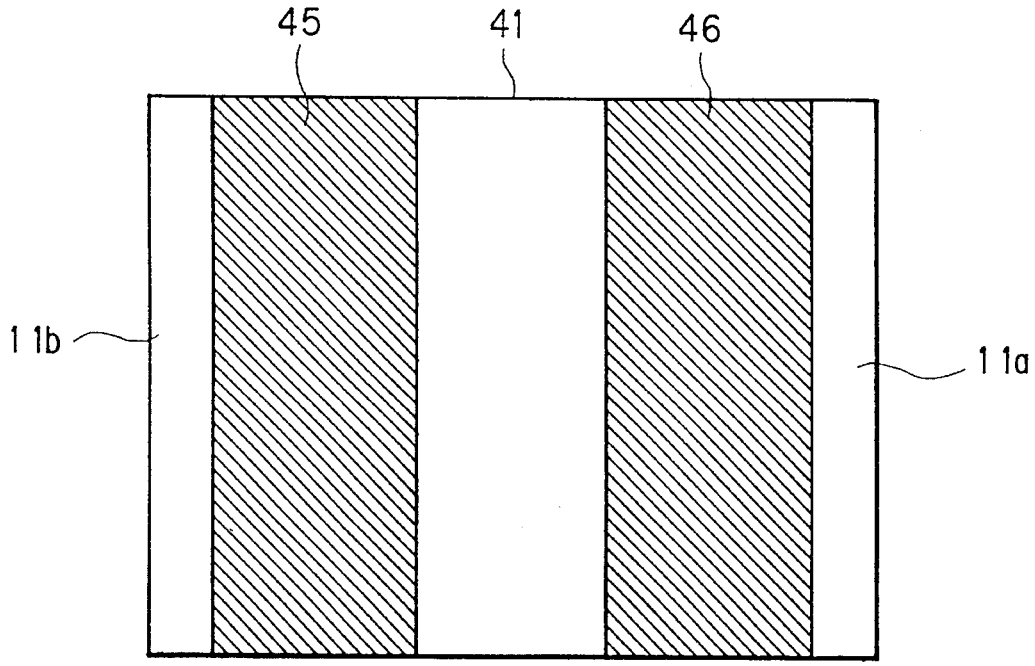
FIG. 7 is a schematic view illustrating another preferred protective sheet having a pair of belt-shaped discriminative marks.
Figure 8:
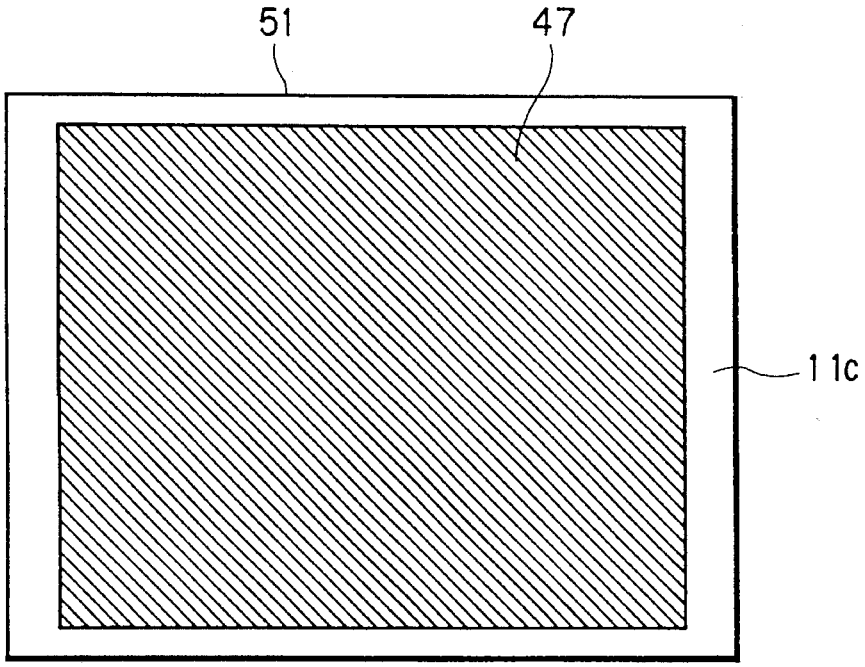
FIG. 8 is a schematic view illustrating still another protective sheet having a single large discriminative mark.

The discriminative marks 13 are printed to be rotationally symmetrical. Alternatively, belt-like discriminative marks 45 and 46 may be printed on a protective sheet 41, with an advancing edge 11*a* and a rear edge 11*b* remaining blank, as illustrated in FIG. 7. A large single discriminative mark 47 may be printed on a protective sheet 51, with a peripheral portion 11*c* blank, as illustrated in FIG. 8. With any pattern of the protective sheet, the blank advancing edge can be detected as it is discriminative from the platen drum 20 having a low factor of reflectance. Any of the discriminative marks of the protective sheets 11, 41, 51 is located at the position sensor 30 when, at latest, the protective sheet 11, 41, 51 comes to the recording station. The information of using up the recording sheets is implied by appearance of the notice indication 14. In addition, a monitor display such as CRT may be disposed on the printer, to indicate information of using up the recording sheets. A buzzer may be used for acoustic information.

In the above embodiment, the clamper 27 is displaced by the solenoid 28 between the open and closed conditions. Alternatively the clamper 27 can be associated with a cam mechanism, which may be driven in linkage with the movement of the clamper 27, and which can displace the clamper 27 as located in the two stations, inclusive of the home position and the exiting station.

The above embodiment is adapted to the monochromatic thermal printer. The invention is also applicable to a color thermal printer. In the color thermal printer, color thermal recording material in use therewith is provided with three-color thermal coloring layers. The printer has two lamps for optical fixation to be different in ultraviolet wavelength. The upper two of the three layers are successively fixed after recording to the coloring layers.

The above embodiment is adapted to the direct thermal printer. The invention is further applicable to a thermal transfer printer. There are two types of thermal transfer printer: a sublimation transfer type in which color ink is sublimated and transferred onto a recording sheet; and a thermal wax transfer type in which color ink is melted and transferred onto a recording sheet. The present invention is also applicable to any other types of a video printer, such as an ink-jet printer and an electronic photo printer called laser printer.

The above embodiments are adapted to a line printer in which a color thermosensitive recording sheet and a thermal head are moved one-dimensionally relative to each other. The present invention is also applicable to a serial printer in which both a color thermosensitive recording sheet and a thermal head are moved.

In the above, the clamper 27 consists of a crank-shaped member to be slid between the open and closed conditions. Alternatively, any other retaining mechanism displaceable between open and closed conditions can be used for retaining the advancing edge of each sheet.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A printer comprising:

a rotatable platen drum having a peripheral face;

a sheet cassette, said cassette containing at least one recording sheet and a protective sheet, said protective sheet having a discriminative mark;

a clamper associated with said platen drum, which can releasably clamp a leading edge of one of said sheets onto said peripheral face of said platen drum;

a recording head that can print on the at least one recording sheet which is clamped to said peripheral face of said platen drum;

a feeding device that advances an advancing edge of one of said sheets toward said peripheral face of said platen drum;

a sensor device that (i) detects an advancing edge of one of said sheets fed by said feeding device when said sheet is in a clampable location and (ii) detects the presence of said discriminative mark contained on one of said sheets clamped to said peripheral face of said platen drum;

a controller means connected to said sensor device for controlling said platen drum and said clamper;

wherein upon detection of an advancing edge of one of said sheets by said sensor device, said controller means causes said clamper to clamp the advancing edge of said sheet to the peripheral face of said platen drum and to rotate said platen drum so that said sheet is placed in a recording station near said recording head for printing; and upon detection of the discriminative mark on said sheet in the recording station, said controller unclamps said advancing edge and ejects said sheet without printing thereon by rotating said platen drum.

2. The printer according to claim 1, wherein said sheet cassette contains plural recording sheets and said protective sheet stacked therein, each recording sheet having a recording surface and being stacked with said recording surface oriented toward said protective sheet; said protective sheet including said discriminative mark disposed away from its advancing edge and on a surface oriented opposite to said recording sheets.

3. The printer as defined in claim 2, wherein each of said recording sheets is a thermosensitive recording sheet and has optical fixability to electromagnetic rays.

4. The printer as defined in claim 3, wherein said discriminative mark and said platen drum have a color of which a factor of optical reflectance is lower than said recording sheet.

5. The printer as defined in claim 3, further comprising a notice indication, disposed on said surface having said discriminative mark, for indicating presence of said protective sheet visually.

6. The printer as defined in claim 3, further comprising a second discriminative mark disposed on said surface having said discriminative mark and in rotationally symmetrical fashion to said discriminative mark.

7. The printer as defined in claim 3, further comprising a second discriminative mark disposed closer to said advancing edge than a rear edge, said second discriminative mark used in place of said discriminative mark if rear edge is advanced in place of said advancing edge;

wherein said discriminative marks are disposed in symmetrical fashion and close to two sides which are transverse to said advancing edge.

8. The printer as defined in claim 3, further comprising a clamper actuating device, controlled by said controller means, for displacing said clamper between a closed condition where said advancing edge is clamped and an open condition where said advancing edge is released;

wherein said protective sheet or said recording sheet is subjected to detection for presence of said discriminating mark with said sensor device when moved to said recording station; and if said sensor device detects said discriminating mark, said controller means causes said clamper actuating device to displace said clamper to said open condition, and to pass said protective sheet through said clamper by rotating said platen drum.

9. The printer as defined in claim 8, wherein;

said feeding device feeds said recording sheet in passing said advancing edge inside said clamper while said clamper stands displaced in said open condition in a home position; and said sensor device detects said advancing edge having passed through said clamper, said clamper actuating device responsively displacing said clamper to said closed condition to clamp said advancing edge.

10. The printer as defined in claim 9, wherein said clamper has a color of which a factor of optical reflectance is higher than said platen drum.

11. The printer as defined in claim 10, wherein said controller means rotates said platen drum prior to advancing said sheet, and in response to detection of said clamper at said sensor device during said prior rotation, stops said platen drum, and subsequently rotates said platen drum in reverse and to a small predetermined extent, said clamper is set in said home position, said clamper actuating device caused to displace said clamper to said open condition in said home position, to stand by for passage of said advancing edge.

12. The printer as defined in claim 11, wherein said feeding device comprising:

a lifting mechanism, contacted on said protective sheet on said surface having said discriminative mark, for raising said plural recording sheets and said protective sheet within said sheet cassette;

a feeding roller, disposed above said sheet cassette, said lifting mechanism bringing an uppermost one of said recording sheets in contact with said feeding roller, said feeding roller driven to move said uppermost sheet away from remaining ones of said recording sheets; and an advancing roller, disposed between said feeding roller and said platen drum, for feeding toward said platen drum said uppermost sheet moved away.

13. The printer as defined in claim 10, further comprising an exit path for ejecting said recording sheet or protective sheet after said recording station, and a stopper device, disposed between said recording head and said exit path, for contacting said clamper displaced in said open condition, to prevent said clamper from following the rotation of said platen drum.

14. The printer as defined in claim 1, wherein said printer is a thermal printer, and said recording head is a thermal head for applying heat to said recording sheet.

* * * * *